United States Patent [19]

Field et al.

[11] Patent Number: 4,903,652

[45] Date of Patent: Feb. 27, 1990

[54] CYLINDER LINER INSERT AND METHOD OF MAKING ENGINE BLOCK THEREWITH

[75] Inventors: Nathanial L. Field, Northville; Benjamin P. Winter, Canton, both of Mich.

[73] Assignee: Ford Motor Company, Dearborn, Mich.

[21] Appl. No.: 386,756

[22] Filed: Jul. 31, 1989

[51] Int. Cl.[4] ..... F02F 7/04

[52] U.S. Cl. ..... 123/193 C; 29/888.061

[58] Field of Search ..... 123/193 C, 41.83, 41.84; 29/156.4 WL

[56] References Cited

U.S. PATENT DOCUMENTS

| | | | |
|---|---|---|---|
| 2,387,971 | 10/1945 | Aspin et al. | 29/156.4 WL |
| 4,109,617 | 8/1978 | Ernest . | |
| 4,197,899 | 4/1980 | Ernest . | |
| 4,394,850 | 7/1983 | Hayashi | 123/193 C |
| 4,446,906 | 5/1984 | Ackerman et al. . | |
| 4,520,768 | 6/1985 | Shimonosono et al. | 123/193 C |
| 4,554,893 | 11/1985 | Vecellio . | |
| 4,686,943 | 8/1987 | Anno et al. . | |
| 4,738,298 | 4/1988 | Taruno et al. . | |
| 4,759,317 | 7/1988 | Ampferer . | |

FOREIGN PATENT DOCUMENTS

| | | | |
|---|---|---|---|
| 0013247 | 1/1982 | Japan | 123/193 C |
| 0085446 | 5/1984 | Japan | 123/193 C |
| 2168631 | 6/1986 | United Kingdom . | |
| 2168632 | 6/1986 | United Kingdom . | |
| 2193786 | 2/1988 | United Kingdom . | |
| 2194472 | 3/1988 | United Kingdom . | |
| 2194473 | 3/1988 | United Kingdom . | |

*Primary Examiner*—Willis R. Wolfe
*Assistant Examiner*—M. Macy
*Attorney, Agent, or Firm*—Joseph W. Malleck; Roger L. May

[57] ABSTRACT

A method of casting-in-place iron cylinder liners in light alloy, preferably aluminum, engine blocks is made possible by a cylinder liner insert comprising at least two generally cylindrical cylinder liners which are joined together along aligned portions of the liners in a "semi-siamese" fashion. The cylinder liners are joined at the lower ends of the liners with the upper combustion ends remaining independent and unattached. Alternately, narrow ribs can be formed at or arched above the upper ends of the liners to join and stabilize the upper ends of the liners during cylinder block casting operations, with such ribs ultimately being machined off during block finishing operations.

23 Claims, 3 Drawing Sheets

CYLINDER LINER INSERT AND METHOD OF MAKING ENGINE BLOCK THEREWITH

BACKGROUND OF THE INVENTION

The present invention relates generally to internal combustion engines and, more particularly, to a cylinder liner insert to be cast-in-place in a light alloy, preferably aluminum, cylinder block, and a method of making a cylinder block with such a cylinder liner insert which comprises at least two generally cylindrical cylinder liners joined together along aligned portions thereof.

A continuing trend in the automotive industry is to reduce the size and weight of modern automobiles and to increase their efficiency in other ways due to fuel shortages and rising fuel costs. In many cases, weight reduction has been pursued by replacing metal components with lighter weight components made of plastics, ceramics or other lighter weight materials. The automobile engine is a major heavyweight component which has been both size reduced and constructed of lighter weight materials. Substantial engine weight reduction has been accomplished by casting the engine cylinder block of light weight alloys, preferably aluminum alloys, as opposed to cast iron.

While cast aluminum engine blocks provide significant engine weight reduction, the wear properties of the cylinder walls must match those of associated piston rings. Traditionally, machined cast iron cylinder liners are pressed into a precast aluminum engine block or preferably, such liners are placed in the block mold prior to casting such that the liners are cast-in-place in the aluminum engine block. In either event, successful operation of the block depends upon the rate at which heat can be extracted from the cylinders across the iron/aluminum interface, which in turn depends upon the contact area between the iron and aluminum.

The provision of individual cylinder liners in a cast-in-place process is illustrated in U.S. Pat. No. 4,446,906. The individual cylinder liners provide a good heat extraction rate since the aluminum is cast circumferentially around the iron liners and its contraction provides good contact with the liners for heat transfer; however, there are disadvantages. For example, the overall size of the engine is greater because space must be provided between cylinders for the core and the casting operation is made more complex due to the required handling of each of the individual cylinder liners.

There is thus a need for an improved cylinder liner and a method for producing a lightweight engine cylinder block by casting-in-place such a cylinder liner.

SUMMARY OF THE INVENTION

This need is met by the present invention which provides a less expensive method of casting-in-Place iron cylinder liners in light alloy, preferably aluminum, engine blocks made Possible by an improved cylinder liner, or more accurately, a cylinder liner insert. The cylinder liner insert of the present invention comprises at least two generally cylindrical cylinder liners which are joined together along aligned portions of the liners in what will be referred to herein as a "semi-siamese" fashion to define a corresponding number of engine cylinders. The cylinder liners are joined preferably at the lower ends of the liners with the upper combustion ends of the liners remaining independent and unattached. Alternately, narrow ribs can be formed at or arched above the upper ends of the liners to join and stabilize the upper ends of the liners during cylinder block casting operations, with such ribs ultimately being machined off during standard block finishing operations.

A less expensive casting operation results since the handling of individual liners for multiple cylinder engine blocks is eliminated. This semi-siamesed cylinder liner insert also permits the design of more compact and hence more space efficient, lighter weight engines while providing good heat transfer characteristics between cylinders at their critical combustion ends. Another advantage of the present invention is enhanced overall rigidity of the engine block due to the joined portions of the liners. Further, no special surface treatments or preheating operations are necessary to produce tight contact between the cylinder liners and the cast aluminum, and no significant changes are required for use of the semi-siamesed cylinder liner inserts in current casting operations.

In accordance with one aspect of the present invention, a cylinder liner insert to be cast-in-place in a light alloy cylinder block for an internal combustion engine comprises at least two generally cylindrical cylinder liners. Each cylinder liner includes an upper end and a lower end, an interior surface for defining a combustion chamber of the engine and an exterior surface adapted to successfully interface with a light alloy during a casting process. Bridge means join the at least two cylinder liners along aligned portions of their exterior surfaces, the aligned portions being spaced from the upper ends of the cylinder liners which correspond to combustion ends of the combustion chambers formed therein. The upper ends of the cylinder liners are thus unattached to permit light alloy to surround them and thereby enhance heat transfer adjacent the combustion ends of the combustion chambers. The bridge means also enhances the rigidity of the cylinder block incorporating a cylinder liner insert of the present invention.

The bridge means preferably extends from the lower ends of the cylinder liners towards the upper ends of the cylinder liners and may extend to a point approximately one sixth of the way toward the upper ends of the cylinder liners. In this way, the upper ends of the cylinder liners are unattached along a maximum possible distance toward the attached lower ends to ensure good alloy/liner contact and hence good heat extraction rates from the critical combustion ends of the engine cylinders defined by the liners. While the bridge means may comprise two or more bridge members which are separated along the axial length of the liners, in its simplest and probably least expensive form the bridge means is continuous. The cylinder liner insert may be formed of cast iron with the external surface of the insert being left "as cast". The as cast surface is smoother and easier for the light alloy to flow around during the molding process than are treated or machined surfaces which are often provided to lock cylinder liners into a cylinder block. The as cast surface can be used in the cylinder liner insert of the present invention since the interconnecting bridge means locks the liner in place in a cylinder block to Prevent rotation or other movement during manufacture and service of the block.

In accordance with another aspect of the present invention, a cylinder liner insert to be cast-in-place in a light alloy cylinder block for an internal combustion engine comprises at least two generally cylindrical cylinder liners. Each cylindrical liner includes an upper end and a lower end, an interior surface for defining a combustion chamber of the engine and an exterior surface adapted to successfully interface with a light alloy during a casting process First bridge means join the at least two cylinder liners along first aligned portions of the exterior surfaces of the cylinder liners, the first aligned portions being spaced from the upper ends of the cylinder liners which correspond to combustion ends of the combustion chambers formed therein. Second bridge means join the at least two cylinder liners along second aligned portions of the exterior surfaces of the cylinder liners, the second aligned portions being adjacent the upper ends of the cylinder liners.

The second bridge means may extend from the upper ends of the cylinder liners toward the lower ends of the cylinder liners to form narrow ribs joining and stabilizing the upper ends of the cylinder liners during cylinder block casting operations. Alternately, the second bridge means may extend upwardly from the upper ends of the cylinder liners to form narrow ribs arching above the upper ends of the cylinder liners to similarly join and stabilize the upper ends of the cylinder liners during cylinder block casting operations.

In accordance with yet another aspect of the present invention, a method of making a light alloy cylinder block for an internal combustion engine including a cylinder liner insert which is cast-in-place comprises the steps of: forming a cylinder liner insert as an integral unit made up of at least two generally cylindrical cylinder liners each of which includes an upper end and a lower end with bridge means for joining the cylinder liners along aligned portions thereof which aligned portions are sized and positioned along the cylinder liners such that the upper ends of the cylinder liners remain unattached; positioning at least one of the cylinder liner inserts into appropriate casting apparatus; performing a casting operation to cast-in-place the at least one cylinder liner to form the light alloy cylinder block; and removing the cylinder block from the casting apparatus.

In accordance with still another aspect of the present invention, a method of making a light alloy cylinder block for an internal combustion engine including a cylinder liner insert which is cast-in-place comprises the steps of: forming a cylinder liner insert as an integral unit made up of at least two generally cylindrical cylinder liners each of which includes an upper end and a lower end, first bridge means for joining the cylinder liners along first aligned portions of the cylinder liners which first aligned portions are spaced from the upper ends of the cylinder liners, and second bridge means for joining the cylinder liners along second aligned portions of the cylinder liners which second aligned portions are adjacent the upper ends of the cylinder liners; positioning at least one of the cylinder liner inserts into appropriate casting apparatus; performing a casting operation to cast-in-place the at least one cylinder liner to form the light alloy cylinder block; and removing the cylinder block from the casting apparatus. In this method, the second bridge means may extend from the upper ends of the cylinder liners toward the lower ends of the cylinder liners to form narrow ribs joining and stabilizing the upper ends of the cylinder liners during the step of performing a casting operation, in which case the method further comprises the step of grinding the upper ends of the resulting cylinder block to eliminate the second bridge means Alternately in this method, the second bridge means may extend upwardly from the upper ends of the cylinder liners to form narrow ribs arching above the cylinder liners to join and stabilize the upper ends of the cylinder liners during the step of performing a casting operation, in which case the method further comprises the step of grinding the upper ends of the resulting cylinder block to eliminate the second bridge means.

It is thus an object of the present invention to provide an improved cylinder liner insert comprising at least two generally cylindrical cylinder liners which are joined together along aligned portions of the liners in semi-siamese fashion; to provide an improved cylinder liner insert comprising at least two generally cylindrical cylinder liners which are joined together at their lower ends with their upper ends remaining substantially unattached; and, to provide an improved cylinder liner insert comprising at least two generally cylindrical cylinder liners which are joined together at their lower ends with narrow ribs formed at or arched above the upper ends of the liners to join and stabilize the upper ends of the liners during cylinder block casting operations.

Other objects and advantages of the invention will be apparent from the following description, the accompanying drawings and the appended claims.

DETAILED DESCRIPTION OF THE INVENTION

Figure 1:
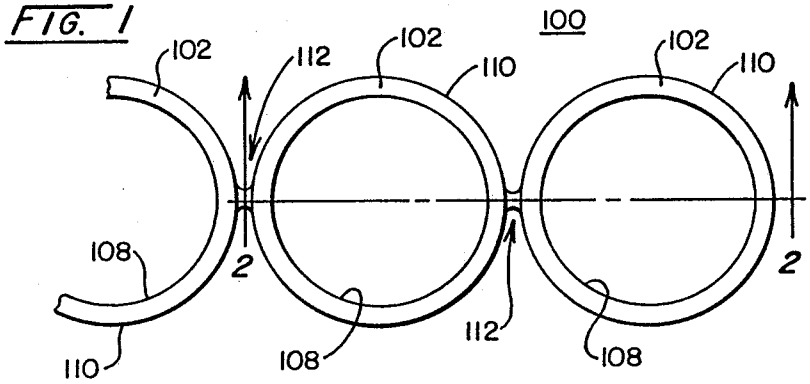
FIG. 1 is a top view of a first embodiment of a semi-siamesed cylinder liner insert in accordance with the present invention.

Reference is now made to the drawing figures which show a number of alternate embodiments of a cylinder liner insert in accordance with the present invention. The cylinder liner insert is cast-in-place to form a light alloy, preferably aluminum, cylinder block for an internal combustion engine. The cylinder liner insert comprises at least two generally cylindrical cylinder liners which are joined together along aligned portions of the liners in a semi-siamesed fashion to define a corresponding number of cylinders for an internal combustion engine incorporating the insert in its engine block.

Figure 2:
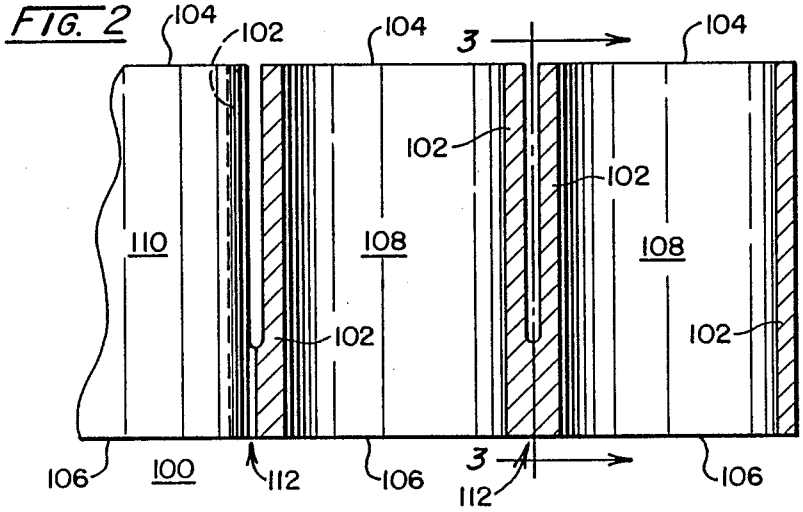
FIG. 2 is a front view of the semi-siamesed cylinder liner insert of FIG. 1 partially sectioned along the section line 2—2.
Figure 3:
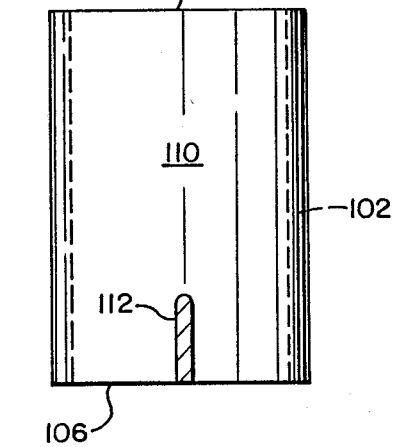
FIG. 3 is an end view of the semi-siamesed cylinder liner insert of FIG. 2 sectioned along the section line 3—3.
Figure 7:
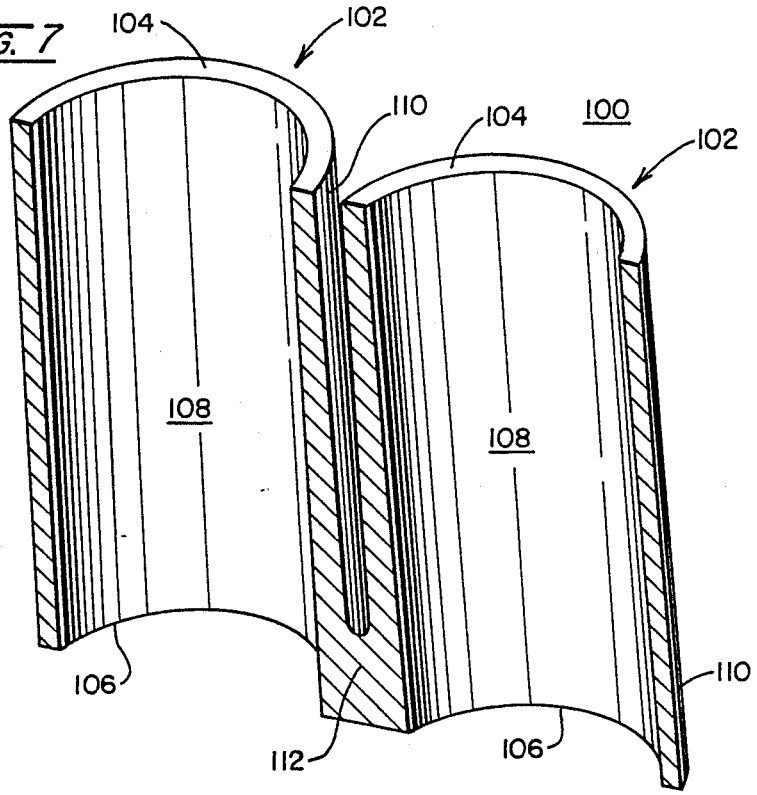
FIG. 7 is a perspective view of a sectioned semi-siamesed cylinder liner insert of the type shown in FIG. 1 comprising two joined liners.

A first embodiment of a cylinder liner insert 100 in accordance with the present invention is shown in FIGS. 1–3 and 7. In FIGS. 1–3, the insert 100 is shown as including three generally cylindrical cylinder liners 102 with the leftmost liner 102 in FIGS. 1 and 2 being shown broken away. In FIG. 7, the insert 100 includes two cylinder liners 102. The cylinder liners 102 have upper ends 104 and lower ends 106, an interior surface 108 for defining a combustion chamber of an engine block incorporating the insert 100, and exterior surface 110 adapted to successfully interface with a light alloy during a casting process.

Preferably, the insert 100 is formed of cast iron and the exterior surface 110 is left "as cast". It should be apparent that the number of cylinder liners 102 included in a given insert 100 is dependent upon the number of cylinders an engine incorporating the insert 100 is to have and the configuration of the engine. For example, a V-6 engine would use two inserts 100 each including three cylinder liners 102, a V-8 engine would use two inserts 100 each including four cylinder liners 102 and a straight-6 engine would use one insert 100 including six cylinder liners 102.

The cylinder liners 102 are joined by bridge means or first bridge means preferably at the lower ends 106 thereof with the upper ends 104, which define the combustion ends of the cylinders formed by the interior surfaces 108 of the liners 102, remaining independent and unattached. In this way, light alloy is able to surround the combustion or upper ends 104 of the cylinder liners 102 during the casting process and thereby enhance heat transfer adjacent the combustion ends of combustion chambers in an engine block formed using one or more of the inserts 100. The bridge means for joining the cylinder liners 102 comprise webs 112 which also serve to enhance the rigidity of a cylinder block incorporating the cylinder liner insert 100.

In the illustrated embodiments of the invention, the webs 112 extend from the lower ends 106 of the cylinder liners 102 toward the upper ends 104 of the cylinder liners 102, for example to a point approximately one sixth of the length of the cylinder liners 102. It is noted that the webs 112 need not be at or immediately adjacent the lower ends 106 of the cylinder liners 102 as long as the upper ends 104 of the cylinder liners 102 are sufficiently open or unattached that the light alloy used to cast an engine block can securely contact the upper ends 104 of the liners 102 for good heat transfer rates thereat. The webs 112 are also shown as being continuous, i.e. there are no gaps or breaks in the webs 112 which would divide the webs 112 into two or more members or segments joining adjacent liners 102. While continuous webs 112 are contemplated as being the preferred and least expensive form of the present invention, segmented webs can also be used.

Figure 4:
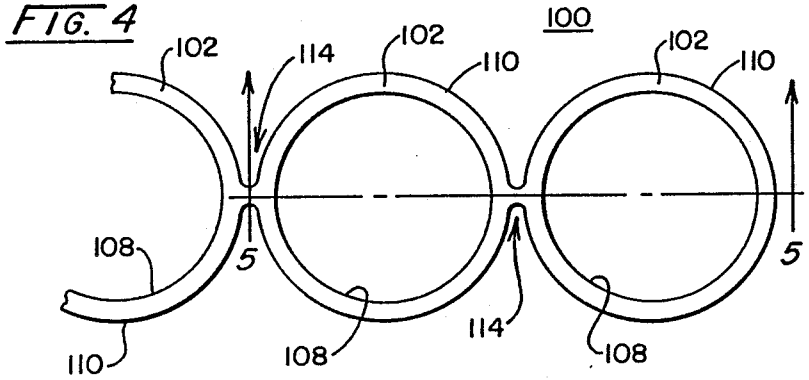
FIG. 4 is a top view of a second embodiment of a semi-siamesed cylinder liner insert in accordance with the present invention.
Figure 5:
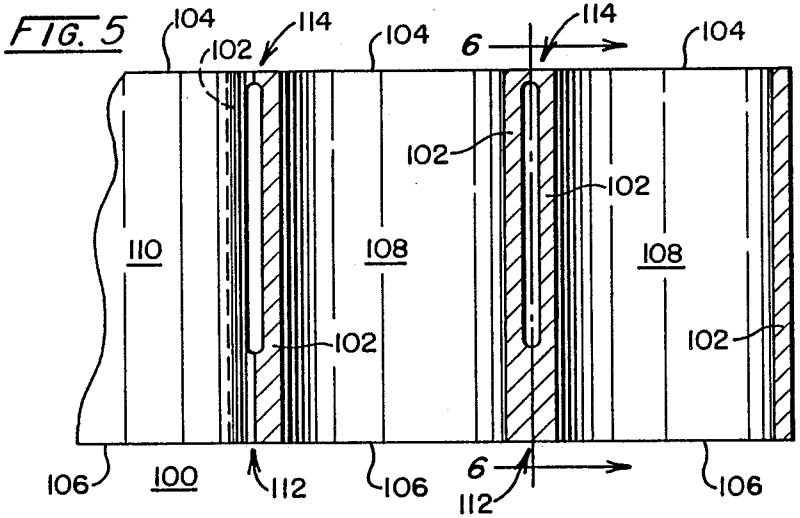
FIG. 5 is a front view of the semi-siamesed cylinder liner insert of FIG. 4 partially sectioned along the section line 5—5.
Figure 6:
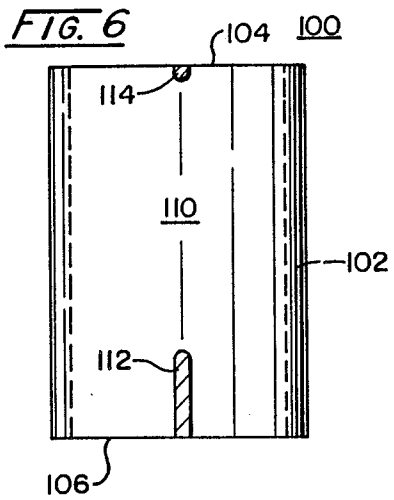
FIG. 6 is an end view of the semi-siamesed cylinder liner insert of FIG. 5 sectioned along the section line 6—6.
Figure 8:
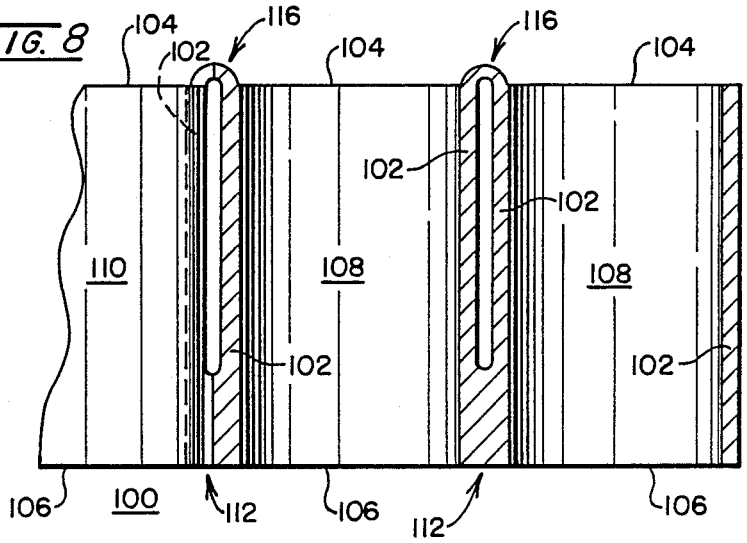
FIG. 8 ia partially sectioned front view of an alternate embodiment of a semi-siamesed cylinder liner of the type shown in FIGS. 4–6.

A second embodiment of the invention is shown in FIGS. 4–6 and an alternate of that embodiment is shown in FIG. 8. Since the embodiments of FIGS. 4–6 and 8 are substantially the same as the embodiments of FIGS. 1–3 and 7 as previously described, except for the addition of second bridge means, corresponding elements will be identified by the same numerical designations. Since aluminum contracts as it solidifies in casting processes, it is possible that the upper ends 104 of the cylinder liners 102 may be deflected from their as-formed or as-cast positions by the forces of the contracting aluminum for some sizes of cylinder liner inserts 100. Such deflections are undesirable in that they lead to nonuniform wall thickness in the liners 102 after final engine block machining. This concern is particularly applicable to inserts 100 made up of minimum thickness liners 102 which, of course, is desired to minimize the weight of engine blocks incorporating the inserts.

The embodiments of the invention shown in FIGS. 4-6 and 8 overcome these problems by providing second bridge means for joining the at least two cylinder liners 102 along second aligned portions of the exterior surfaces 110 of the cylinder liners 102, with the second aligned portions being adjacent the upper ends 104 of the cylinder liners 102. As shown in FIGS. 4–6, the second bridge means extends from the upper ends 104 of the cylinder liners 102 toward the lower ends 106 of the cylinder liners 102 to form narrow ribs 114 joining and stabilizing the upper ends 104 of the cylinder liners during cylinder block casting operations. The narrow ribs 114 and a portion of the upper ends 104 of the liners 102, if required, are machined off after block formation since the aluminum fill around the ribs 114 may not provide satisfactory heat transfer rates. To potentially reduce the machining required, the second bridge means may extend upwardly from the upper ends 104 of the cylinder liners 102 to form narrow ribs 116 arching above the cylinder liners 102 to join and stabilize the upper ends 104 of the cylinder liners 102 during cylinder block casting operations.

The present invention includes a method of making a light alloy, preferably aluminum, cylinder block for an internal combustion engine including one or more cylinder liner inserts 100 in accordance with the teachings of the preceding disclosure which liner insert(s) is cast-in-place to form the cylinder block. The method comprises the steps of: forming a cylinder liner insert 100 as an integral unit made up of at least two generally cylindrical cylinder liners 102 each of which includes an upper end 104 and a lower end 106 with bridge means comprising webs 112 joining the cylinder liners 102 along aligned portions thereof which aligned portions are sized and positioned along the cylinder liners 102 such that the upper ends 104 of the cylinder liners 102 remain unattached; positioning at least one of the cylinder liner inserts 100 into appropriate casting apparatus; performing a casting operation to cast-in-place the at least one cylinder liner insert 100 to form the light alloy cylinder block; and removing the cylinder block from the casting apparatus.

Alternately, the method may include the step of forming a cylinder liner insert 100 as an integral unit made up of at least two generally cylindrical cylinder liners 102 each of which includes an upper end 104 and a lower end 106, first bridge means comprising webs 112 joining the cylinder liners 102 along first aligned portions of the cylinder liners 102 which first aligned portions are spaced from the upper ends 104 of the cylinder liners 102, and second bridge means comprising narrow ribs 114 joining the cylinder liners 102 along second aligned portions of the cylinder liners 102 which second aligned portions are adjacent the upper ends 104 of the cylinder liners 102; positioning at least one of the cylinder liner inserts 100 into appropriate casting apparatus; performing a casting operation to cast-in-place the at least one cylinder liner 100 to form the light alloy cylinder block; and removing the cylinder block from the casting apparatus.

The second bridge means may extend from the upper ends 104 of the cylinder liners 102 toward the lower ends 106 of the cylinder liners 102 to form narrow ribs 114 joining and stabilizing the upper ends 104 of the cylinder liners 102 during the step of performing a casting operation, with the method further comprising the step of grinding the upper ends of the cylinder block to eliminate the narrow ribs 114. Alternately, the second bridge means may extend upwardly from the upper ends 104 of the cylinder liners 102 to form narrow ribs 116 arching above the cylinder liners 102 to join and stabilize the upper ends 104 of the cylinder liners 102 during the step of performing a casting operation, with the method also further comprising the step of grinding the upper ends of the cylinder block to eliminate the second bridge means.

It should be apparent that an improved cylinder liner insert 100 and a method of making a light alloy cylinder block using one or more of the inserts 100 have been disclosed to provide simpler less expensive light alloy cylinder block casting. By being semi-siamesed, inserts 100 of the present invention permit two or more cylinder liners to be handled in one operation while still providing good heat extraction rates for cylinder blocks formed using the inserts. Semi-siamesed joining of the inserts 102 stably positions the inserts 102 while also permitting the relative positions of the inserts to be easily controlled. The inserts can be used with their exterior surfaces remaining as-cast such that no special machining is required on the liners to form vertical or horizontal grooves for locking the liners into a cylinder block, as may be required in the prior art. Not only does this eliminate machining operations and costs but it also provides a smoother surface which is easier for the casting alloy to flow around and make good contact with the cylinder liners. Further, liner preheat temperatures are sufficiently low that the inserts 100 can be used with steel die or sand mold casting.

Having thus described the cylinder liner and method of using the liner to make an engine block of the present invention in detail and by reference to preferred embodiments thereof, it will be apparent that modifications and variations are Possible without departing from the scope of the invention defined in the appended claims.

What is claimed is:

1. A cylinder liner insert to be cast-in-place in a light alloy cylinder block for an internal combustion engine, said cylinder liner insert comprising:

at least two generally cylindrical cylinder liners each of which includes an upper end and a lower end, an interior surface for defining a combustion chamber of said engine and an exterior surface adapted to successfully interface with a light alloy during a casting process; and bridge means for joining said at least two cylinder liners along aligned portions of the exterior surfaces of said cylinder liners, said aligned portions being spaced from said upper ends of said cylinder liners which correspond to combustion ends of the combustion chambers formed therein to permit said light alloy to surround the combustion ends of said cylinder liners and thereby enhance heat transfer adjacent the combustion ends of said combustion chambers, said bridge means also serving to enhance the rigidity of the cylinder block incorporating said cylinder liner insert.

2. A cylinder liner insert to be cast-in-place in a light alloy cylinder block for an internal combustion engine as claimed in claim 1 wherein said bridge means extends from the lower ends of said cylinder liners toward the upper ends of said cylinder liners.

3. A cylinder liner insert to be cast-in-place in a light alloy cylinder block for an internal combustion engine as claimed in claim 2 wherein said bridge means extends from the lower ends of said cylinder liners to a point approximately one sixth of the way toward the upper ends of said cylinder liners.

4. A cylinder liner insert to be cast-in-Place in a light alloy cylinder block for an internal combustion engine as claimed in claim 3 wherein said bridge means is continuous.

5. A cylinder liner insert to be cast-in-place in a light alloy cylinder block for an internal combustion engine as claimed in claim 4 wherein said cylinder liner insert is formed of cast iron.

6. A cylinder liner insert to be cast-in-place in a light alloy cylinder block for an internal combustion engine as claimed in claim 5 wherein the exterior surface of said cylinder liner insert is left as cast.

7. A cylinder liner insert to be cast-in-place in a light alloy cylinder block for an internal combustion engine, said cylinder liner insert comprising:

at least two generally cylindrical cylinder liners each of which includes an upper end and a lower end, an interior surface for defining a combustion chamber of said engine and an exterior surface adapted to successfully interface with a light alloy during a casting process;

first bridge means for joining said at least two cylinder liners along first aligned portions of the exterior surfaces of said cylinder liners, said first aligned portions being spaced from said upper ends of said cylinder liners which correspond to combustion ends of the combustion chambers formed therein; and second bridge means for joining said at least two cylinder liners along second aligned portions of the exterior surfaces of said cylinder liners, said second aligned portions being adjacent said upper ends of said cylinder liners.

8. A cylinder liner insert to be cast-in-place in a light alloy cylinder block for an internal combustion engine as claimed in claim 7 wherein said second bridge means extends from the upper ends of said cylinder liners toward the lower ends of said cylinder liners to form narrow ribs joining and stabilizing the upper ends of said cylinder liners during cylinder block casting operations.

9. A cylinder liner insert to be cast-in-place in a light alloy cylinder block for an internal combustion engine as claimed in claim 8 wherein said first bridge means extends from the lower ends of said cylinder liners toward the upper ends of said cylinder liners.

10. A cylinder liner insert to be cast-in-place in a light alloy cylinder block for an internal combustion engine as claimed in claim 9 wherein said first bridge means extends from the lower ends of said cylinder liners to a point approximately one sixth of the way toward the upper ends of said cylinder liners.

11. A cylinder liner insert to be cast-in-place in a light alloy cylinder block for an internal combustion engine as claimed in claim 10 wherein said first bridge means is continuous.

12. A cylinder liner insert to be cast-in-place in a light alloy cylinder block for an internal combustion engine as claimed in claim 11 wherein said cylinder liner insert is formed of cast iron.

13. A cylinder liner insert to be cast-in-place in a light alloy cylinder block for an internal combustion engine as claimed in claim 12 wherein the exterior surface of said generally cylindrical liner insert is left as cast.

14. A cylinder liner insert to be cast-in-place in a light alloy cylinder block for an internal combustion engine as claimed in claim 7 wherein said second bridge means extends upwardly from the upper ends of said cylinder liners to form narrow ribs arching above said cylinder liners to join and stabilize the upper ends of said cylinder liners during cylinder block casting operations.

15. A cylinder liner insert to be cast-in-place in a light alloy cylinder block for an internal combustion engine as claimed in claim 14 wherein said first bridge means extends from the lower ends of said cylinder liners toward the upper ends of said cylinder liners.

16. A cylinder liner insert to be cast-in-place in a light alloy cylinder block for an internal combustion engine as claimed in claim 15 wherein said first bridge means extends from the lower ends of said cylinder liners to a point approximately one sixth of the way toward the upper ends of said cylinder liners.

17. A cylinder liner insert to be cast-in-place in a light alloy cylinder block for an internal combustion engine as claimed in claim 16 wherein said first bridge means is continuous.

18. A cylinder liner insert to be cast-in-place in a light alloy cylinder block for an internal combustion engine as claimed in claim 17 wherein said cylinder liner insert is formed of cast iron.

19. A cylinder liner insert to be cast-in-place in a light alloy cylinder block for an internal combustion engine as claimed in claim 18 wherein the exterior surface of said cylinder liner insert is left as cast.

20. A method of making a light alloy cylinder block for an internal combustion engine including a cylinder liner insert which is cast-in-place, said method comprising the steps of:

forming a cylinder liner insert as an integral unit made up of at least two generally cylindrical cylinder liners each of which includes an upper end and a lower end with bridge means for joining said cylinder liners along aligned portions thereof which aligned portions are sized and positioned along said cylinder liners such that the upper ends of said cylinder liners remain unattached;

positioning at least one of said cylinder liner inserts into appropriate casting apparatus;

performing a casting operation to cast-in-place said at least one cylinder liner to form said light alloy cylinder block; and removing said cylinder block from said casting apparatus.

21. A method of making a light alloy cylinder block for an internal combustion engine including a cylinder liner insert which is cast-in-place, said method comprising the steps of:

forming a cylinder liner insert as an integral unit made up of at least two generally cylindrical cylinder liners each of which includes an upper end and a lower end, first bridge means for joining said cylinder liners along first aligned portions of said cylinder liners which first aligned portions are spaced from said upper ends of said cylinder liners, and second bridge means for joining said cylinder liners along second aligned portions of said cylinder liners which second aligned portions are adjacent the upper ends of said cylinder liners;

positioning at least one of said cylinder liner inserts into appropriate casting apparatus;

performing a casting operation to cast-in-place said at least one cylinder liner to form said light alloy cylinder block; and removing said cylinder block from said casting apparatus.

22. A method of making a light alloy cylinder block for an internal combustion engine including a cylinder liner insert which is cast-in-place as claimed in claim 21 wherein said second bridge means extends from the upper ends of said cylinder liners toward the lower ends of said cylinder liners to form narrow ribs joining and stabilizing the upper ends of said cylinder liners during the step of performing a casting operation, said method further comprising the step of grinding the upper ends of said cylinder block to eliminate said second bridge means.

23. A method of making a light alloy cylinder block for an internal combustion engine including a cylinder liner insert which is cast-in-place as claimed in claim 21 wherein said second bridge means extends upwardly from the upper ends of said cylinder liners to form narrow ribs arching above said cylinder liners to join and stabilize the upper ends of said cylinder liners during the step of performing a casting operation, said method further comprising the step of grinding the upper ends of said cylinder block to eliminate said second bridge means.

* * * * *